US009232844B2

(12) United States Patent
Thompson

(10) Patent No.: US 9,232,844 B2
(45) Date of Patent: Jan. 12, 2016

(54) COSMETICS CONTAINER

(71) Applicant: International Cosmetic Suppliers Ltd, Taipei (TW)

(72) Inventor: David Julian Cave Thompson, Taipei (TW)

(73) Assignee: INTERNATIONAL COSMETIC SUPPLIERS LTD, Taipei (TW)

( * ) Notice: Subject to any disclaimer, the term of this patent is extended or adjusted under 35 U.S.C. 154(b) by 0 days.

(21) Appl. No.: 14/509,799

(22) Filed: Oct. 8, 2014

(65) Prior Publication Data

US 2015/0096919 A1 Apr. 9, 2015

Related U.S. Application Data

(60) Provisional application No. 61/888,384, filed on Oct. 8, 2013.

(51) Int. Cl.
*A45D 40/00* (2006.01)

(52) U.S. Cl.
CPC ..... *A45D 40/00* (2013.01); *A45D 2040/0012* (2013.01); *A45D 2040/0018* (2013.01)

(58) Field of Classification Search
CPC ..... B65D 11/02; B65D 41/04; B65D 1/14; A45D 40/00; A45D 2040/0025; A45D 2040/0012; A45D 2040/0068; A45C 13/008
USPC ..... 206/385, 581, 823; 220/4.25, 4.24, 220/23.89; 132/318, 317, 320; 401/88, 98
See application file for complete search history.

(56) References Cited

U.S. PATENT DOCUMENTS

| | | | |
|---|---|---|---|
| 1,852,455 | A | 10/1930 | Friedman |
| 2,171,112 | A | 8/1939 | Hoffman |
| 5,044,496 | A | 9/1991 | Tanaka et al. |
| 5,137,185 | A | 8/1992 | Mitchell |
| 5,503,825 | A | 4/1996 | Lane |

(Continued)

FOREIGN PATENT DOCUMENTS

| | | |
|---|---|---|
| CA | 2073730 | 1/1993 |
| CA | 2041057 | 5/1995 |

(Continued)

OTHER PUBLICATIONS

English abstract for DE9114136; published on Mar. 18, 1993 and retrieved on Jan. 16, 2014.

(Continued)

*Primary Examiner* — Steven A. Reynolds
(74) *Attorney, Agent, or Firm* — Novak Druce Connolly Bove + Quigg LLP

(57) ABSTRACT

A cosmetics container includes a shelf portion with a cosmetic material retention area which is configured to receive a cosmetic material. The container can include a base portion which can include a shelf portion-receiving section. The container can have a top portion which includes a base portion-receiving section, whereby the top portion can releasably engage with the base portion or the shelf portion or both. The top portion can form a transverse line along a portion of an exterior of the container when the container is in an assembled configuration. The transverse line can form a plane which bisecting the container. The base portion can have a truncated region with a substantially flat area. The substantially flat area can form an angle with the bisecting plane when the container is in the assembled configuration.

12 Claims, 8 Drawing Sheets

(56) References Cited

U.S. PATENT DOCUMENTS

| | | | | |
|---|---|---|---|---|
| 5,792,496 | A | 8/1998 | Fekete et al. | |
| 5,908,037 | A | 6/1999 | Pierson | |
| 6,047,710 | A * | 4/2000 | Irving et al. | 132/293 |
| 6,102,209 | A | 8/2000 | D'Andrea | |
| 6,354,308 | B1 | 3/2002 | Kuk | |
| D481,636 | S | 11/2003 | Camacho | |
| 6,840,694 | B2 | 1/2005 | Gueret | |
| 6,945,403 | B2 | 9/2005 | Lombardi | |
| D529,397 | S | 10/2006 | Lavigne et al. | |
| D540,170 | S | 4/2007 | Canamasas | |
| 7,234,885 | B2 | 6/2007 | Gueret | |
| D555,505 | S | 11/2007 | Brandt | |
| D564,900 | S * | 3/2008 | Green et al. | D9/715 |
| D582,063 | S | 12/2008 | Spangler et al. | |
| D582,580 | S | 12/2008 | Spangler et al. | |
| 7,631,781 | B2 | 12/2009 | Chen | |
| D619,896 | S | 7/2010 | Iwazu et al. | |
| D631,204 | S | 1/2011 | Dubitsky et al. | |
| 8,286,821 | B2 | 10/2012 | Mejia et al. | |
| 8,444,337 | B2 | 5/2013 | Teller | |
| D690,055 | S | 9/2013 | Chen | |
| 8,651,308 | B1 * | 2/2014 | Sung | 220/4.25 |
| 2001/0027958 | A1 | 10/2001 | Short et al. | |
| 2003/0201201 | A1 | 10/2003 | Cheng | |
| 2006/0000742 | A1 * | 1/2006 | Consulich | A45D 33/006 206/581 |
| 2006/0063621 | A1 | 3/2006 | Bell et al. | |
| 2006/0201941 | A1 * | 9/2006 | Lee | 220/4.21 |
| 2006/0254945 | A1 * | 11/2006 | Green et al. | 206/457 |
| 2007/0017542 | A1 * | 1/2007 | Petit | A45D 33/02 132/293 |
| 2007/0108092 | A1 * | 5/2007 | Minuto et al. | 206/581 |
| 2009/0016799 | A1 | 1/2009 | Bellas | |
| 2009/0101654 | A1 | 4/2009 | Brashear | |
| 2011/0011418 | A1 * | 1/2011 | Gatesoupe | A45D 33/006 132/293 |
| 2011/0024316 | A1 * | 2/2011 | Ginsburg | 206/385 |
| 2011/0135377 | A1 * | 6/2011 | Teller | 401/88 |
| 2011/0253731 | A1 * | 10/2011 | Smith | 220/751 |
| 2012/0308694 | A1 | 12/2012 | Price et al. | |
| 2013/0105476 | A1 | 5/2013 | Hammer et al. | |
| 2013/0168269 | A1 | 7/2013 | Eddy | |
| 2013/0308993 | A1 | 11/2013 | Teller | |
| 2013/0322950 | A1 | 12/2013 | Teller | |

FOREIGN PATENT DOCUMENTS

| | | |
|---|---|---|
| DE | 9114136 | 3/1993 |
| DE | 202012104020 | 10/2012 |
| EP | 0523943 | 1/1993 |
| EP | 1068817 | 1/2001 |
| EP | 1136015 | 9/2001 |
| EP | 1415568 | 5/2004 |
| FR | 2726442 | 5/1996 |
| FR | 2726443 | 5/1996 |
| FR | 2766339 | 1/1999 |
| FR | 2873549 | 2/2006 |
| WO | 0126501 | 4/2001 |
| WO | 2007072123 | 6/2007 |

OTHER PUBLICATIONS

English abstract for DE2020121404020; published Oct. 30, 2012 and retrieved on Jan. 16, 2014.

English abstract for FR2726442; published May 10, 1996 and retrieved on Jan. 16, 2014.

English abstract for FR2726443; published May 10, 1996 and retrieved on Jan. 16, 2014.

English abstract for FR2766339; published on Jan. 29, 1999 and retrieved on Jan. 16, 2014.

English abstract for FR2873549; published on Feb. 3, 2006 and retrieved on Jan. 16, 2014.

Notice of Allowance mailed Apr. 1, 2015 in U.S. Appl. No. 29/475,725.

* cited by examiner

COSMETICS CONTAINER

CROSS-REFERENCE TO RELATED APPLICATION

This application claims priority to U.S. Provisional Application No. 61/888,384, filed on Oct. 8, 2013, the contents of which are entirely incorporated by reference herein.

FIELD OF DISCLOSURE

The present disclosure relates generally to storage containers. The present disclosure relates specifically to containers for storing and transporting cosmetic substances or materials in a user-accessible state.

BRIEF DESCRIPTION OF THE DRAWINGS

Embodiments of the present application will now be described, by way of example only, with reference to the attached Figures, wherein.

DETAILED DESCRIPTION

Figure 1:
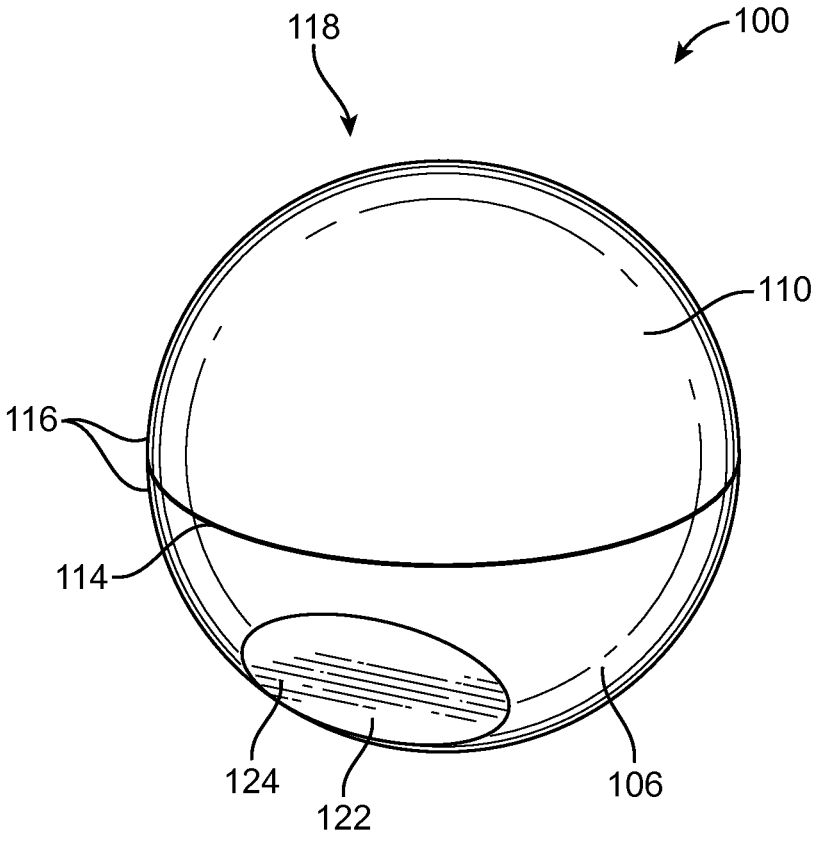
FIG. 1 illustrates a perspective view of a cosmetics container in an assembled configuration.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein.

In at least one embodiment within this disclosure, a cosmetics container can comprise a shelf portion. The shelf portion can include a cosmetic-retention area, configured to receive a cosmetic material, such as lip balm, and lip stick for example. The cosmetics container can include a base portion which includes a shelf portion-receiving section, and a top portion, which includes a base portion-receiving section. The shelf portion, the base portion and the top portion can be coupled together in an assembled configuration. Other intermediate components can also be included within the container, such as for example, a washer between the shelf portion and the base portion. The top portion of the cosmetics container can be configured to be releasably engage with the base portion. The area where the top portion and the base portion couple can form a transverse line along a portion of an exterior of the container when the container is in an assembled configuration. The transverse line can thereby form a plane which bisects the container. It will be understood that the bisecting plane can divide the container into two regions which are approximately the same size, although this does not have to be the case. For example, it is possible within this disclosure that one region can be larger than the other.

In at least one embodiment of the container, the base portion can have a truncated region with a substantially flat area. The substantially flat area can form an angle with the bisecting plane described above, as when the container is in the assembled configuration. The angle between the bisecting plane and the substantially flat area can be approximately 45 degrees. The angle between the bisecting plane and the substantially flat area can be approximately 27.5 degrees. As used throughout this disclosure, the term "approximately" will be understood to have its normal and plain meaning with the art. The term "approximately" can mean "close to" or "as near as can be determined by the unaided eye." The angle between the bisecting plane and the substantially flat area can also be between 46 and 27.5 degrees. Other angles are possible within this disclosure. The container ran rest on any substantially flat surface on its truncated region. This is useful because it can obviate the need for a user to rotate the container in order to dispense the cosmetic material within the container. This can also mean that the container can rest "on its side" and thereby be displayed in a more attractive manner than if the truncated area were not present.

In at least one embodiment, the cosmetic-retention area forms a grid. The grid can be formed so as to suitably receive, retain and accessibly provide a suitable cosmetic material or cosmetic substance to a user of the container.

In at least one embodiment, the cosmetic-retention area can include a perforated area or region. Perforations can be square shaped, circular shaped and oblong shaped. Other perforations and perforation patterns are possible In at least one embodiment, the shelf portion can be configured so as to be removable from the base portion. It is also possible for the shelf portion and the base portion to be co-molded. It is also possible for the shelf portion and the base portion to be formed from a single piece.

In at least one embodiment of the cosmetics container the exterior of the container can forms a spherical shape or semi-spherical shape when the container is in the assembled configuration. In at least one embodiment, the exterior of the container can a polyhedral shape, forming a cube, a pyramid, a dodecahedron or other shape.

In at least one embodiment, the exterior of the container can be fashioned so as to have the appearance of one of an article of fruit, an article of candy or a game ball. For example, the container could be made to look like an apple or an orange. The container can be given the outward appearance of a gumball or a baseball. Other exterior appearances are possible within this disclosure.

At least one embodiment of a cosmetic dispenser according to the present disclosure can omit the top portion covering the cosmetic material as described above. Instead a protective cover can be applied directly to the cosmetic. In yet other embodiments, the top portion can be replaced by a disposable cover.

In at least one embodiment, a cosmetics dispenser can have a shelf portion which includes a cosmetic-retention area, the cosmetic-retention area configured to receive a cosmetic material. The dispenser can include a base portion, having an upper area, the upper area being fashioned to receive the shelf section which houses the cosmetic material. The upper area of the base can have a lip running substantially its perimeter. The lip will be understood as possibly forming or creating a plane or plane section. A lower area of the base portion can have a truncated region with a substantially flat area. The substantially flat area can form an angle with the plane.

In at least one embodiment of the cosmetics dispenser the angle between the plane and the substantially flat area will be approximately 45 degrees. In at least one embodiment, the angle between the plane and the substantially flat area is approximately 27.5 degrees. In at least one embodiment, the angle between the plane and the substantially flat area is between 46 and 27.5 degrees. Other variations of the formed angle are possible within this disclosure.

In at least one embodiment of the cosmetics dispenser, the portions of the cosmetic-retention area can be formed into a grid. In at least one embodiment, the cosmetic-retention area comprises at least one perforated area. In at least one embodiment, at least one perforation of the perforated area is square shaped. In at least one embodiment, at least one perforation forming the perforated area is circular. In at least one embodiment, at least one perforation forming the perforated area is oblong.

In at least one embodiment of the cosmetics dispenser, the shelf portion is removable from the base portion. However, the shelf portion and the base portion can also be fashioned from a single piece. It is also possible that the shelf portion and the base portion can be co-molded.

FIG. 1 illustrates a perspective view of an example of an embodiment of a cosmetics container 100 in an assembled configuration 118. A top portion 110 is releasably coupled to a base portion 106. The top portion 110 and the base portion 106 meet at a line 114 which runs around the exterior 116 of the container 100. The base portion 106 has truncated region 122 or truncated area which is discontinuous with the rest of the base portion 106. In this illustrated embodiment, the truncated region 122 has a bottom surface area 124 which is substantially flat, although other shapes and textures are possible within this disclosure. For example, within the present disclosure the area 124 can be dimpled or impregnate with a friction-inducing material. The components of the cosmetic container can be made from plastic or some other polycarbonate material or other suitable material or combination thereof.

Figure 2:
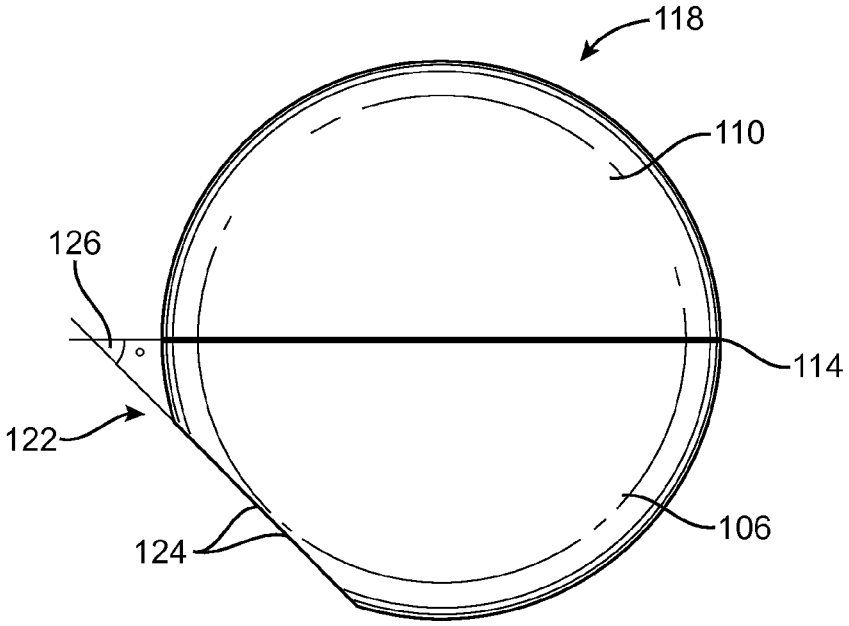
FIG. 2 illustrates a left side elevational view of a cosmetics container in an assembled configuration.

FIG. 2 illustrates a left side elevational view of a cosmetics container 100 in an assembled configuration 118. The top portion 110 sits atop the bottom portion 106 forming a line 114 between the two. The substantially flat area 124 of the truncated region 122 can be seen to form an angle 126 with line 114 (or to be more exact, an angle with a plane formed by line 114, as will be discussed below).

Figure 3:
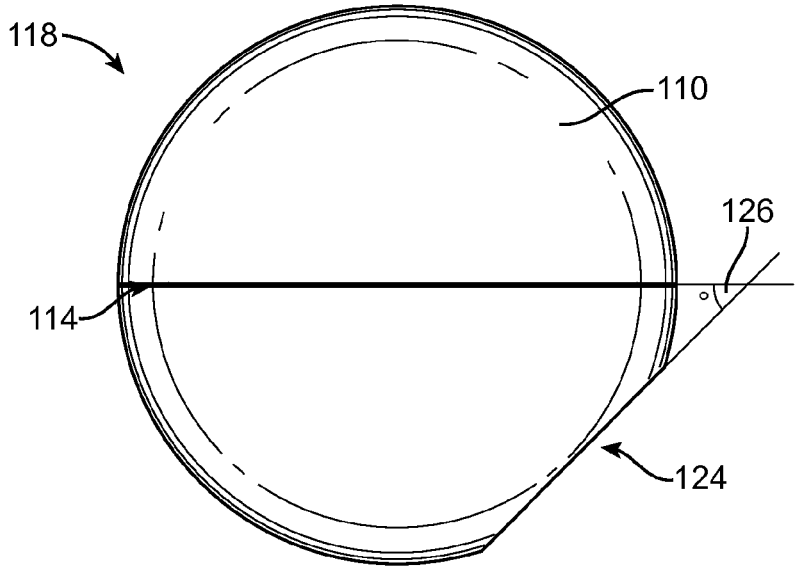
FIG. 3 illustrates a right side elevational view of a cosmetics container in an assembled configuration.

FIG. 3 illustrates a right side elevational view of a cosmetics container 100 in an assembled configuration 118. As with FIG. 3, the substantially flat area 124 of the truncated region 122 can be seen to form an angle 126 with line 114.

Figure 4:
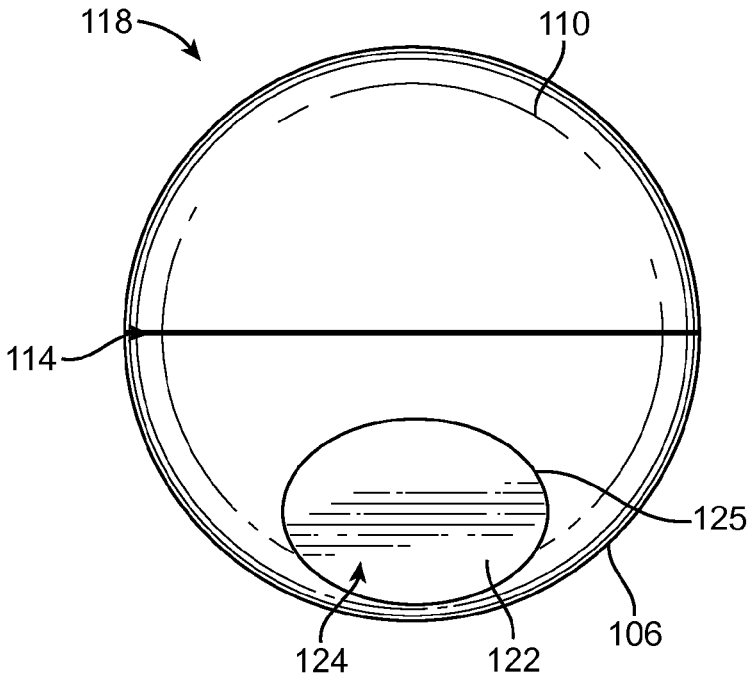
FIG. 4 illustrates a front elevational view of a cosmetics container in an assembled configuration.

FIG. 4 illustrates a front elevational view of a cosmetics container 100 in an assembled configuration 118. The outer boundary 125 of the truncated region 122 forms an oval in this illustration, although the outer boundary 125 can form other shapes. The outer boundary 125 is such that the flat region 124 is substantially within the outer boundary 125 is also present. When a flat region 124 is provided according to the present disclosure, the container 100 will rotate on a flat surface until the flat region 124 is encountered and then the container 100 with stop and maintain its position such that the flat region 124 is substantially parallel to the flat surface.

Figure 5:
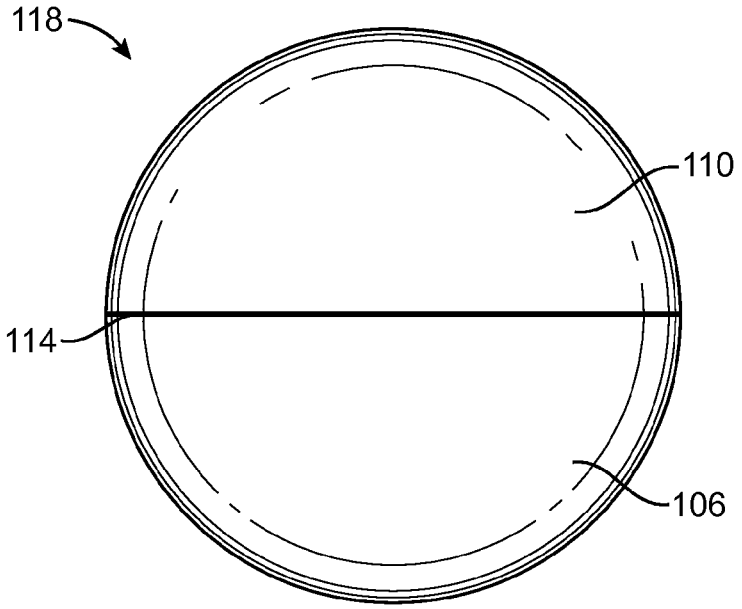
FIG. 5 illustrates a rear elevational view of a cosmetics container in an assembled configuration.

FIG. 5 illustrates a rear-elevational view of a cosmetics container 100 in an assembled configuration 118. As was true in the preceding figures, the top portion 110 sits above the base portion 106 and a line 114 is formed where they meet.

Figure 6:
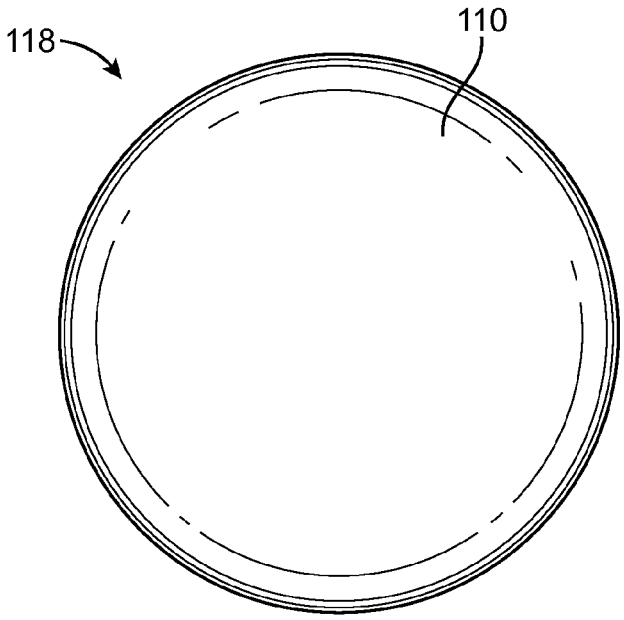
FIG. 6 illustrates a top plan view of a cosmetics container in an assembled configuration.

FIG. 6 illustrates a top plan view of a cosmetics container 100 in an assembled configuration 118. Because the remainder of the container 100 is obscured by the top portion 110, only the top portion 110 is visible. The top portion 110 can be configured with recesses or protuberances to assist a user in opening the container 100. The top portion 110 can be suitably decorated via silk screening, wraps, painting, or other application techniques, as can the bottom portion (not shown).

Figure 7:
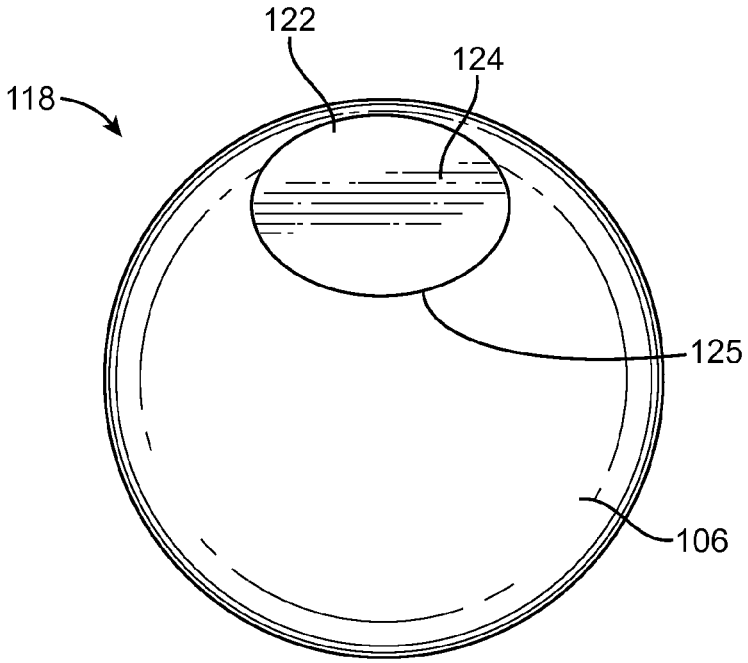
FIG. 7 illustrates a bottom plan view of a cosmetics container in an assembled configuration.

FIG. 7 illustrates a bottom plan view of a cosmetics container 100 in an assembled configuration 118. As indicated when discussing FIG. 4, the outer boundary 125 of the truncated region 122 forms an oval, although it is possible for the outer boundary 125 to form other shapes. Again, the flat region 124 within the outer boundary 125 is also present.

Figure 8:
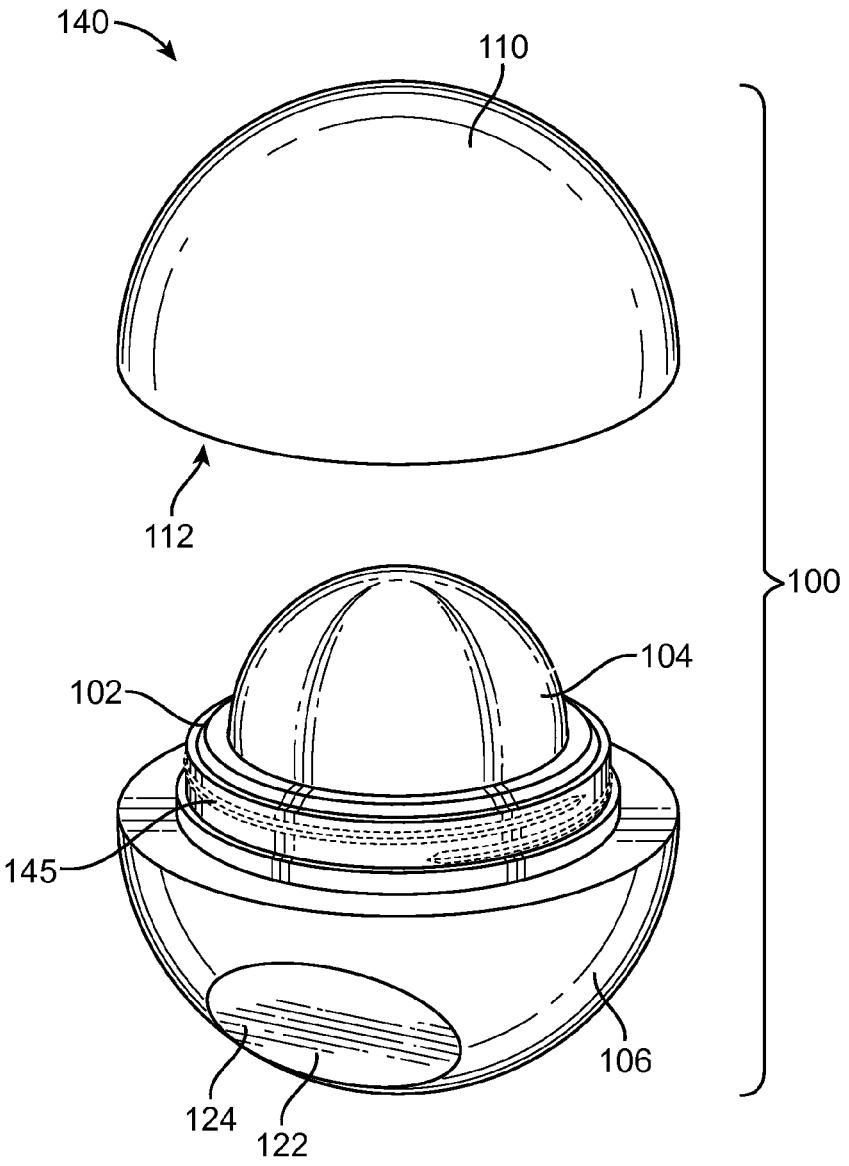
FIG. 8 illustrates a partially exploded perspective view of a cosmetics container.

FIG. 8 illustrates a partially exploded view 140 of a cosmetics container 100. The partially exploded view can be considered to show a disassembled or partially disassembled configuration of the cosmetics container 100. The top portion 110 can include a base-portion receiving section 112 (not visible). The receiving section 112 can include a threaded region configured to receive the threads 145 of the shelf portion, thereby enabling the top portion 110 to be releasably joined to the base portion 106. Although threads are illustrated, other connecting means are also possible within this disclosure. A cosmetic material 104 or cosmetic substance, (such as lip balm) is visible. The cosmetic material 104 rests and is held in place on the shelf portion 102, which can be seen to be interposed between the top portion 110 and the base portion 106. The top portion 110 can shield the cosmetic material 104 when the container 100 is in an assembled configuration 118. The top portion 110 can be removed from the base portion 106 in order for a user to access the cosmetic material 104. In this example, the shelf portion 102 can reside within the shelf portion receiving portion of the base portion.

Figure 9:
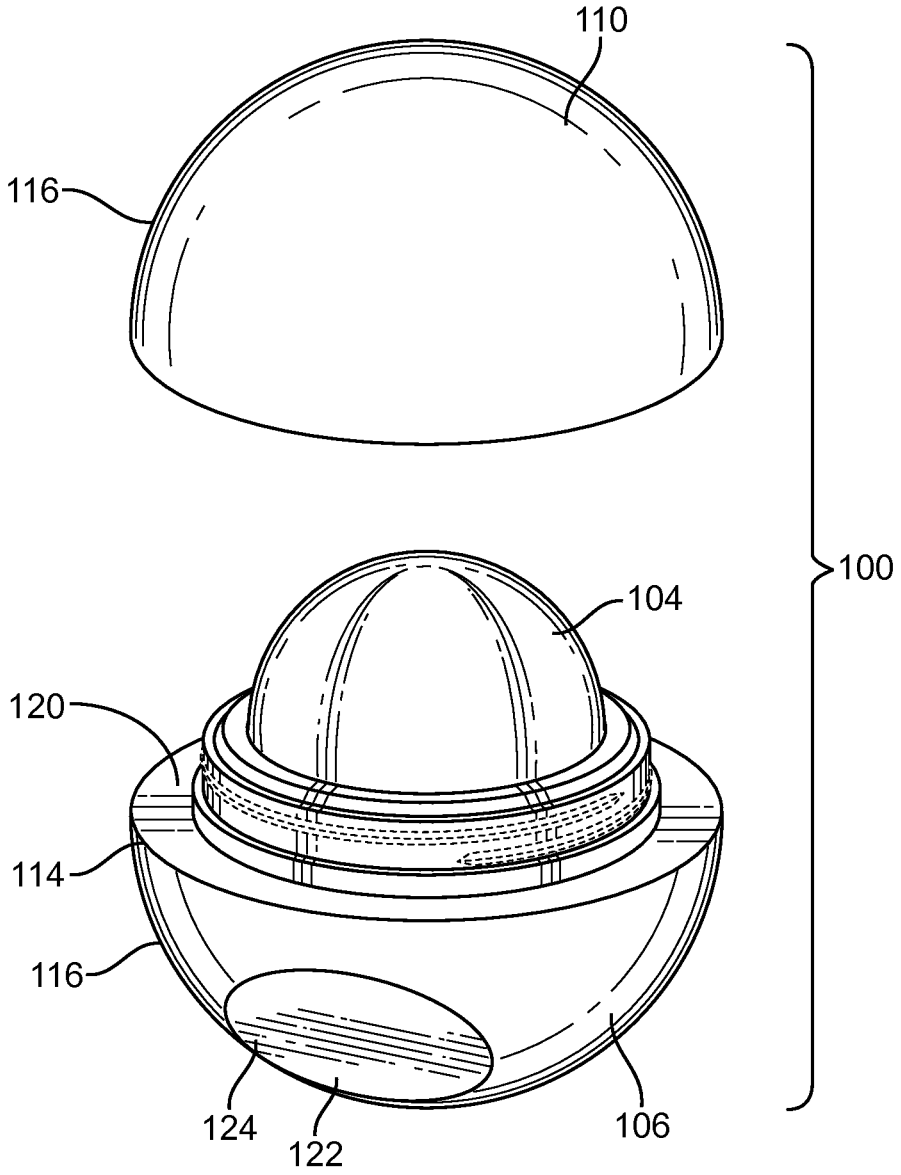
FIG. 9 illustrates another partially exploded perspective view of a cosmetics container.

FIG. 9 illustrates another partially exploded view 140 of a cosmetics container 100. As discussed above, the top portion 110 and the base portion 106, when the container 100 is in the assembled configuration 118, form a transverse line 114 which runs along a portion of an exterior 116 of the container 100 when the container 100 is the assembled configuration 118. As shown, the transverse line forms a plane 120 which bisects the container 100 (though not necessarily into two equal portions. As discussed above, plane 120 and substantially flat area 124 form an angle 126 between them, (see, for example, FIG. 2 and FIG. 3).

Figure 10:
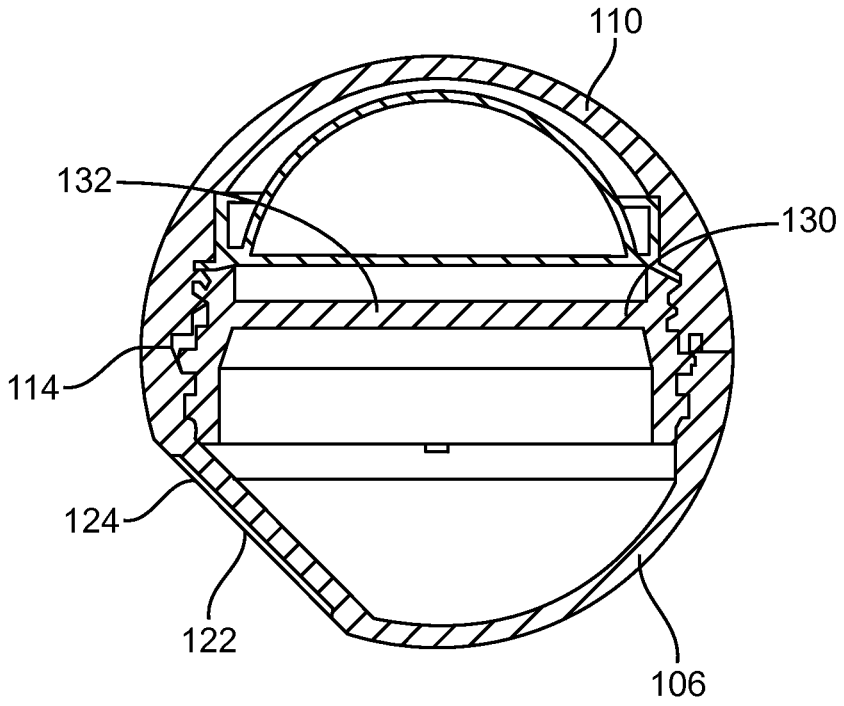
FIG. 10 illustrates an cross-sectional view of a cosmetics container.

FIG. 10 illustrates an internal view of a cosmetics container 100 at cross-section AA (see FIG. 6). The top portion 110 is shown releasable engaged with the base portion 106. The base portion-receiving receiving section 112 of the top portion 110 is joined to threads 145 below, the threads 114 running along the exterior of the shelf portion 102. In this illustration, the shelf portion 102 and the base portion 106 are formed from separate pieces, although as discussed above, it is also possible for the shelf portion 102 and the base portion 106 to be formed in a single piece. Line 114 formed on the exterior 116 of the container 110 where the top portion 110 and the base portion 106 meet is also visible.

Figure 11:
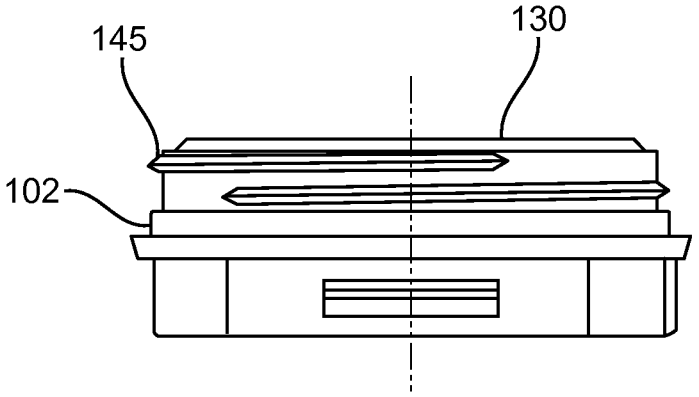
FIG. 11 illustrates a side elevational view of the shelf portion of a cosmetics container.

FIG. 11 illustrates a side view of the shelf portion 102 in isolation. Threads 145 can be seen and the location of a cosmetic material retention area 130 within the shelf portion 102 is indicated.

Figure 12:
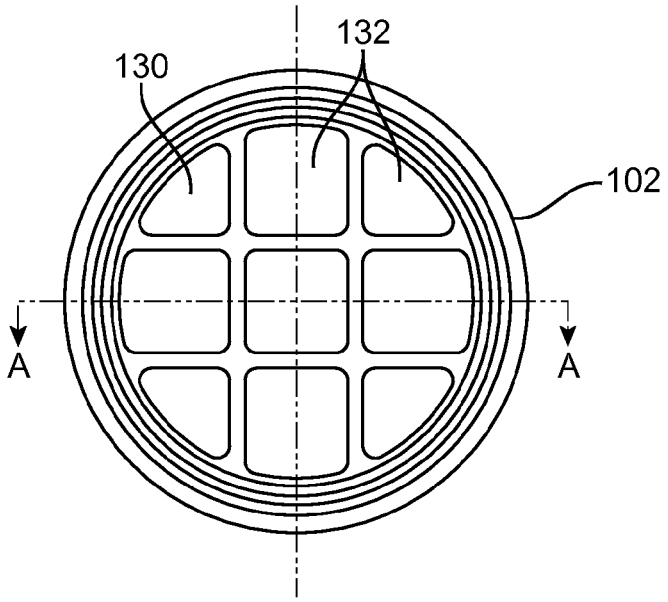
FIG. 12 illustrates a top plan view of an example shelf portion of a cosmetics container, according to the present disclosure.

FIG. 12 illustrates a top plan view of the shelf portion 102. Within the shelf portion 102 is the cosmetic material retention area 130 which is configured to receive a cosmetic substance and to house and provide the cosmetic material (104) to the user during use of the container 110. In the example of FIG. 12, the cosmetic material retention area is perforated 132 with square and triangular shapes, though other shapes and patterns are possible within this disclosure, such as, for example, the formation of a grid.

Figure 13:
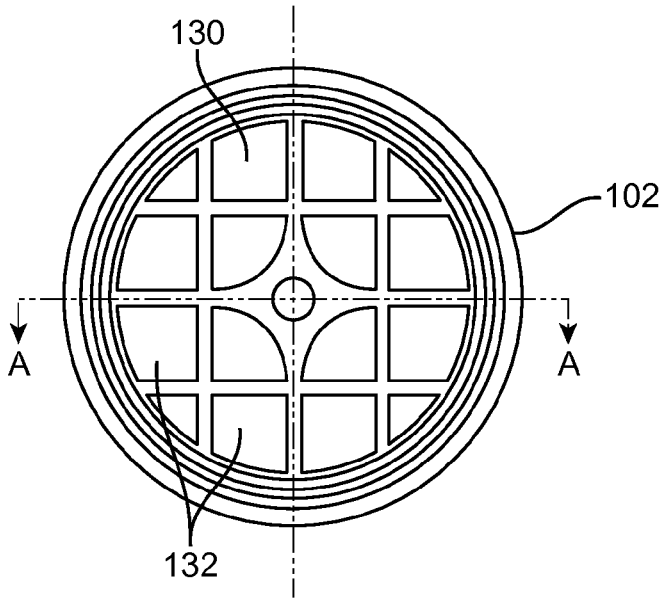
FIG. 13 illustrates a top plan view of another example shelf portion, according to the present disclosure.

FIG. 13 illustrates another top plan view of the shelf portion 102. The perforated regions 132 of the cosmetic material retention area 130 have a different pattern than the one illustrated in FIG. 12. Different patterns and perforations may be suitably utilized depending on the method by which the cosmetic material (104) is deposited on the retention area 130 or the type of cosmetic material (104) involved.

Exemplary non-limiting embodiments have been described herein. Various modifications to, and departures from, the described embodiments may occur without departing from this disclosure. The subject matter that is intended to be governed by this disclosure is set forth in the following claims.

The invention claimed is:

1. A cosmetics container comprising:

a shelf portion, including a cosmetic material retention area, configured to receive a cosmetic material;

a base portion, including a shelf portion-receiving section;

a top portion, including a base portion-receiving section;

the top portion, configured to releasably engage with the base portion at the base portion-receiving section, forming a transverse line along a portion of an exterior of the container when the container is in an assembled configuration, the transverse line forming a plane bisecting the container;

wherein the base portion has a truncated region with a substantially flat area located at a longitudinal distance from the bottom and from a top of the base portion, the substantially flat area forming an angle with the bisecting plane when the container is in the assembled configuration, the angle being approximately 45 degrees;

wherein the exterior of the container forms a spherical shape when the container is in the assembled configuration.

2. The cosmetics container of claim 1, wherein a portion of the cosmetic-retention area forms a grid.

3. The cosmetics container of claim 1, wherein the cosmetic-retention area comprises at least one perforated area.

4. The cosmetics container of claim 3, wherein at least one perforation forming the perforated area is square shaped.

5. The cosmetics container of claim 3, wherein at least one perforation forming the perforated area is circular.

6. The cosmetics container of claim 3, wherein at least one perforation forming the perforated area is oblong.

7. The cosmetics container of claim 1, wherein the shelf portion is removable from the base portion.

8. The cosmetics container of claim 1, wherein the shelf portion and the base portion are co-molded.

9. The cosmetics container of claim 1, wherein the shelf portion and the base portion are formed in a single piece.

10. A cosmetics dispenser comprising:

a shelf portion, including a cosmetic material retention area, the cosmetic material retention area configured to receive a cosmetic material;

a base portion, having an upper area, the upper area including a shelf portion-receiving section;

wherein the upper area of the base portion includes a lip running substantially around a perimeter of the base portion , thereby forming a plane, and a lower area of the base portion has a truncated region with a substantially flat area located at a longitudinal distance from the bottom and from a top of the base portion, the substantially flat area forming an angle with the plane, the angle being approximately 45 degrees;

wherein the exterior of the container forms a spherical shape when the container is in the assembled configuration.

11. The cosmetics dispenser of claim 10, wherein a portion of the cosmetic-retention area forms a grid.

12. The cosmetics dispenser of claim 10, wherein the cosmetic-retention area comprises at least one perforated area.

* * * * *